US005267539A

United States Patent [19]

Becker et al.

[11] Patent Number: 5,267,539

[45] Date of Patent: Dec. 7, 1993

[54] ELECTRO-PNEUMATIC ENGINE STARTER

[75] Inventors: Robert J. Becker, Huber Heights; Terry L. Coons, Dayton, both of Ohio

[73] Assignee: Tech Development, Inc., Dayton, Ohio

[21] Appl. No.: 938,624

[22] Filed: Sep. 1, 1992

[51] Int. Cl.[5] ..... F02N 7/08

[52] U.S. Cl. ..... 123/179.31; 60/626

[58] Field of Search ..... 123/179.31; 60/625, 60/626, 627

[56] References Cited

U.S. PATENT DOCUMENTS

| | | | |
|---|---|---|---|
| 3,094,845 | 6/1963 | Mallofre | 123/179.31 |
| 3,182,650 | 5/1965 | Heckt | 123/179.31 |
| 4,494,499 | 1/1985 | Stein | 123/179.31 |
| 4,679,533 | 7/1987 | Klie et al. | 123/179.31 |
| 4,960,085 | 10/1990 | Coons | 123/179.31 |

*Primary Examiner*—Andrew M. Dolinar

*Attorney, Agent, or Firm*—Leydig, Voit & Mayer

[57] ABSTRACT

A vehicle engine starter includes a self-contained solenoid-operated valve and a self-contained relay valve which simplify installation of the starter by reducing the number of electrical and pneumatic hook-ups between the starter and the electrical and pneumatic systems of the vehicle.

2 Claims, 5 Drawing Sheets

ELECTRO-PNEUMATIC ENGINE STARTER

BACKGROUND OF THE INVENTION

This invention relates generally to an electro-pneumatic starter of the type used for starting an engine and particularly the engine of a large over-the-road truck or other vehicle having a source of compressed air for operating air brakes or the like. An electro-pneumatic starter of the same general type as the starter of the present invention is disclosed by Coons U.S. Pat. No. 4,960,085 and specifically by FIGS. 15–21 thereof.

The starter disclosed in the Coons patent includes a drive gear which is adapted to be shifted axially into engagement with the bull gear of the engine. Thereafter, the drive gear is rotated by a turbine rotor driven by high pressure air admitted into the housing of the starter from the compressed air supply of the vehicle.

To effect shifting of the drive gear and to control the flow of pressurized air to the starter housing, the system of the Coons patent requires a plurality of electrical connections to the electrical system of the vehicle and requires a plurality of valves and air lines separate from the starter housing itself. Thus, installation of the starter is cumbersome and time-consuming since multiple components must be attached to the vehicle and since multiple pneumatic and electrical connections must be made.

SUMMARY OF THE INVENTION

The general aim of the present invention is to provide a new and improved electro-pneumatic starter which is virtually self-contained and which lends itself to quicker and easier installation than prior starters of the same general type.

A more detailed object of the invention is to achieve the foregoing through the provision of a starter requiring only a single connection to the electrical system of the vehicle and requiring only a single air line to the compressed air supply of the vehicle.

Still another object is to provide an electro-pneumatic starter in which all valves and valve actuators are part of the starter itself so as to avoid the need of installing separate valves and actuators during installation of the starter.

These and other objects and advantages of the invention will become more apparent from the following detailed description when taken in conjunction with the accompanying drawings.

DETAILED DESCRIPTION OF THE PREFERRED EMBODIMENT

Figure 1:
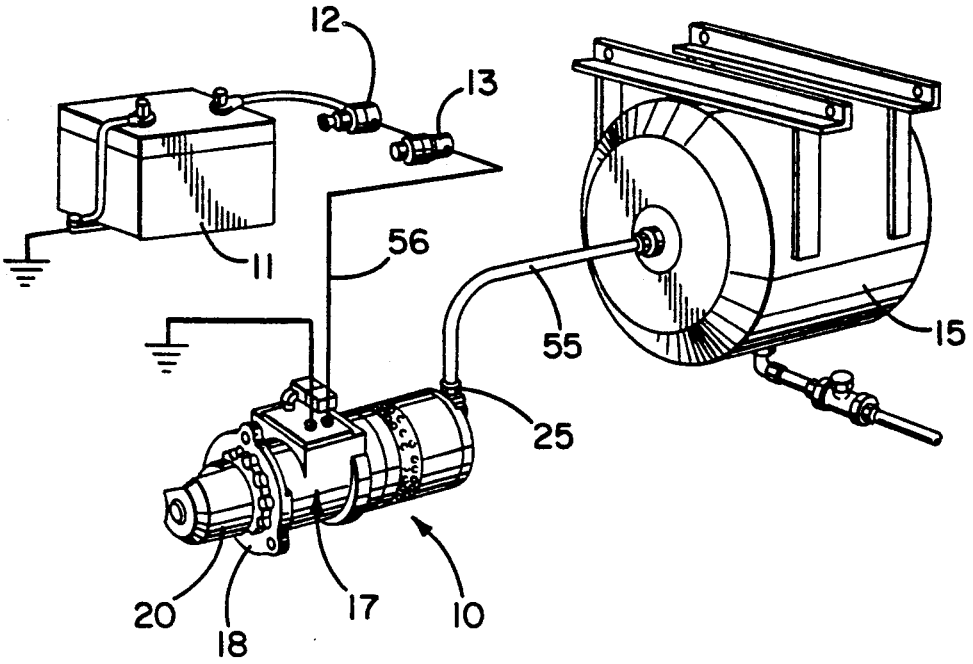
FIG. 1 is a perspective view schematically showing a typical vehicle installation having a new and improved electro-pneumatic starter incorporating the unique features of the present invention.

For purposes of illustration, the invention has been shown in the drawings as embodied in an electro-pneumatic starter 10 for starting an engine such as the engine of a large over-the-road truck. As is conventional, the truck includes an electrical system having a storage battery 11, a key-operated ignition switch 12 and a push button-operated starter switch 13. The truck also includes a compressed air system having a reservoir or tank 15 containing compressed air which is used to operate the air brakes, the starter 10 and other components of the truck.

The starter includes a generally cylindrical composite housing 17 (FIGS. 2–5) formed by multiple housing components fastened together in end-to-end relation. Located near the front of the housing is a mounting flange 18 formed with angularly spaced holes 19 adapted to receive bolts (not shown) for attaching the starter to the engine. Formed integrally with and extending forwardly from the flange is a housing component 20 which rotatably supports an engine drive gear 22, the latter being rotatable with and slidable along the shaft. Normally, the drive gear 22 is disposed in a retracted inactive position shown in FIG. 3 and, when in this position, the drive gear is spaced rearwardly from and is located out of meshing engagement with a bull gear (not shown) associated with the flywheel of the engine. When the starter 10 is actuated, the drive gear is shifted forwardly along the shaft 21 (see FIG. 4) and into engagement with the bull gear. Thereafter, the shaft 21 is rotated to cause the drive gear 22 to turn the bull gear and effect starting of the engine. After the engine starts, the drive gear is retracted to its inactive position shown in FIG. 3.

Advancement of the drive gear 22 to its active starting position and subsequent rotation of the shaft 21 and the drive gear are effected by pressurized air. For this purpose, compressed air from the tank 15 is supplied to the starter 10 via an inlet 25 near the rear of the housing 17. After the drive gear has been advanced to its active position, pressurized air from the inlet 25 is admitted through a series of angularly spaced nozzles 26 (FIG. 2) formed in a nozzle unit 27. After flowing through the nozzles 26, the pressurized air impacts against angularly spaced turbine buckets 28 on a turbine rotor 29. The latter is secured to a shaft 30 which forms the input of a two-stage planetary speed reducer 31 whose output is connected to the rear end of the shaft 21. Thus, the turbine rotor 29 acts through the speed reducer 31 to rotate the shaft 21 and the drive gear 22 with high torque.

A tubular drive assembly 35 transmits torque from the shaft 21 to the drive gear 22 while permitting the drive gear to shift axially between its active and inactive positions. The drive assembly is a commercially available unit such as, for example, that sold by Facet Enterprises, Inc. and designated as FACET POSITORK PLUS. The drive assembly 35 includes a housing 37 having an internally splined hub 39 (FIGS. 3 and 4) which is telescoped over and mates with a splined portion 41 of the shaft 21. The drive gear 22 is attached to the forward end of the housing 37 while a plastic ring 43 is secured to the rear of the housing 37. A coil spring 45 is compressed between the housing component 20 and the ring 43 and urges the housing 37 rearwardly so as to bias the drive gear 22 toward its inactive position.

Shifting of the drive gear 22 to its active position is effected in response to the admission of pressurized air into a chamber 47 (FIGS. 3 and 4) in the housing 17. For this purpose, a tubular piston 49 is slidable Within the chamber 47 and is sealed to the housing 17 by a pair of axially spaced 0-rings 50 and 51. The piston is piloted onto a bearing hub 52 on the shaft 21 and is sealed to the hub by an 0-ring 53. When pressurized air is admitted into the chamber 47, the piston 49 is advanced forwardly to the position shown in FIG. 4 and acts against the ring 43 to effect forward shifting of the drive assembly 35 with the attached drive gear 22. When pressurized air is exhausted from the chamber 47, the spring 45 acts against the ring 43 to retract the drive assembly and the drive gear.

In accordance with the present invention, installation of the starter 10 in the vehicle is simplified significantly by virtue of the fact that the starter is connected to the compressed air system of the vehicle by only a single air line 55 (FIG. 1) and is connected to the electrical system of the vehicle by only a single electrical line 56. Thus, the starter may be installed simply by bolting the starter to the engine, by connecting the single air line 55 to the compressed air system and by connecting the single electrical line 56 to the electrical system.

More specifically, the air line 55 leads from the compressed air tank 15 to the main air inlet 25 of the housing 17. There are no intervening valves in the line 55 and thus pressurized air is present at the inlet 17 at all times when compressed air is in the tank. The inlet 17 communicates with a chamber 58 (FIGS. 3 and 4) in the rear end portion of the housing 17, the chamber 58 also being pressurized at all times.

The electrical line 56 is connected between the button-operated start switch 13 and the terminal block 60 (FIGS. 4 and 5) of a microprocessor 62 mounted on the housing 17 about midway between its ends. A control valve 65 is mounted directly on and is attached directly to the housing 17 adjacent the microprocessor and, in this particular instance, is a two-position, three-way valve adapted to be shifted by an electrically operated actuator such as a solenoid 67. The solenoid 67 is energized by way of the microprocessor 62 and, when energized, shifts the valve 65 to one of its positions. The valve is shifted to its other (i.e., normal) position when the solenoid is de-energized.

Figure 2:
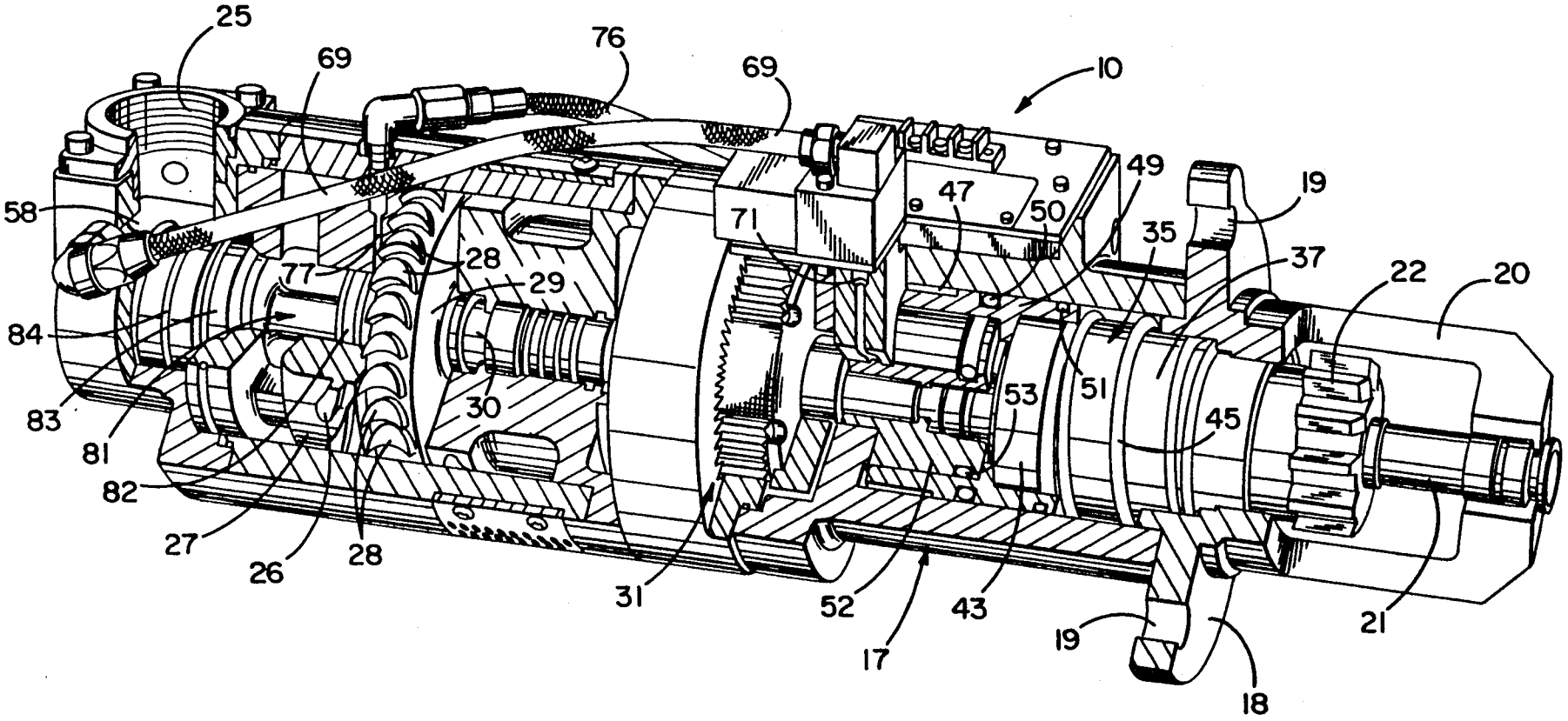
FIG. 2 is a perspective view of the starter with certain parts being broken away and shown in section.
Figure 4:
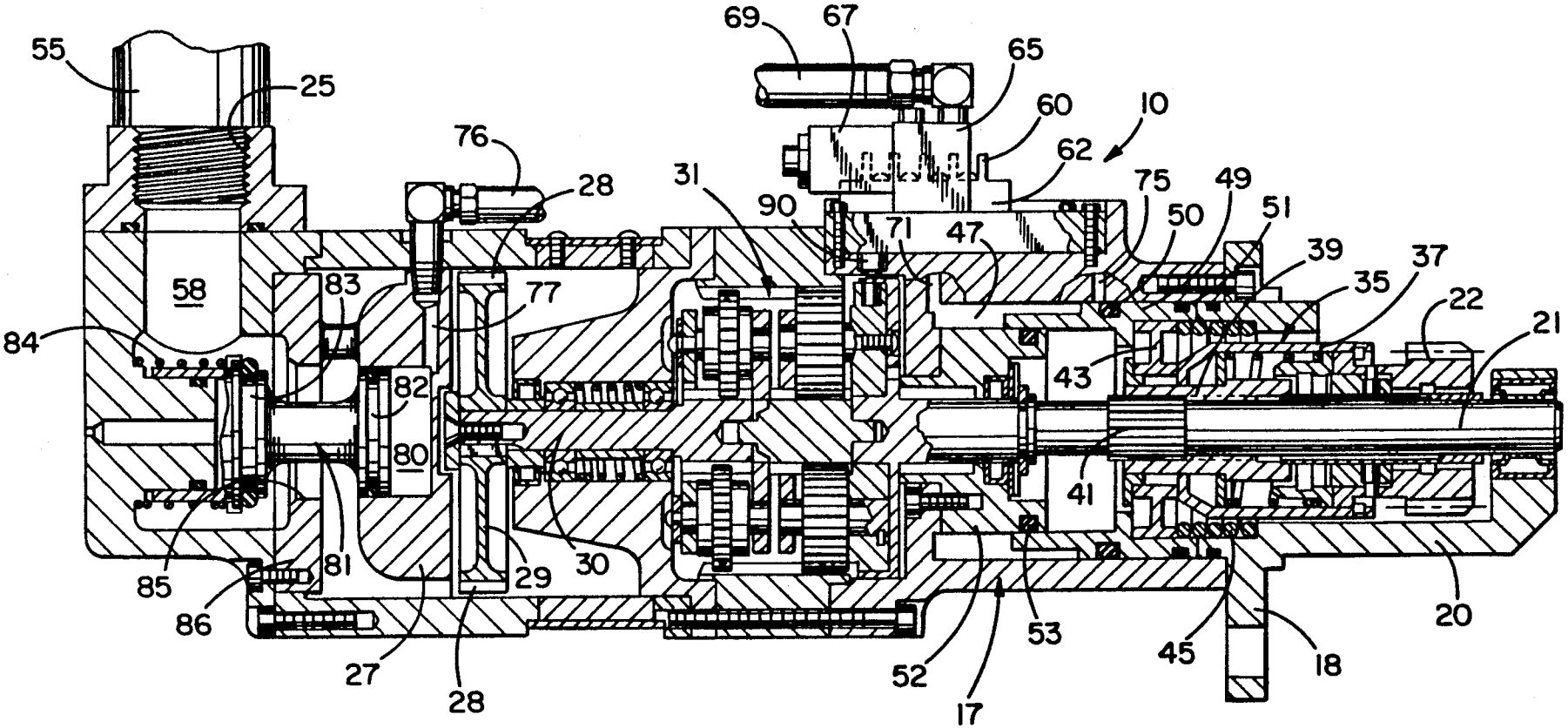
FIG. 4 is a view similar to FIG. 3 but shows components of the starter in position to start the engine.
Figure 5:
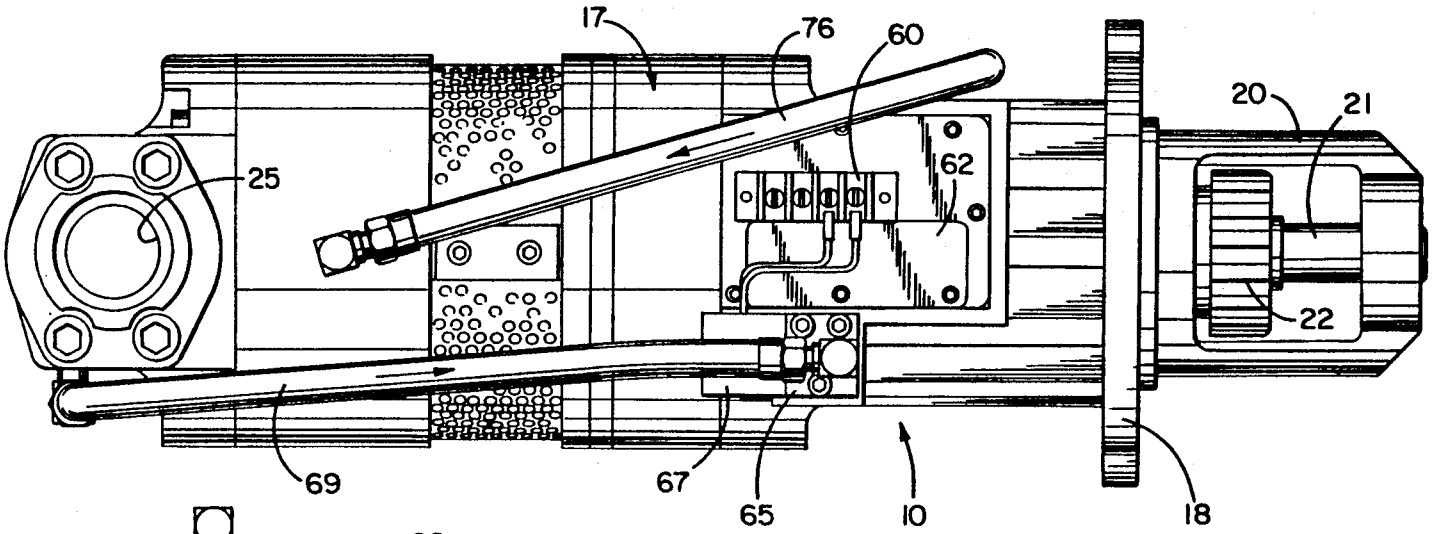
FIG. 5 is a top plan view of the starter.
Figure 6:
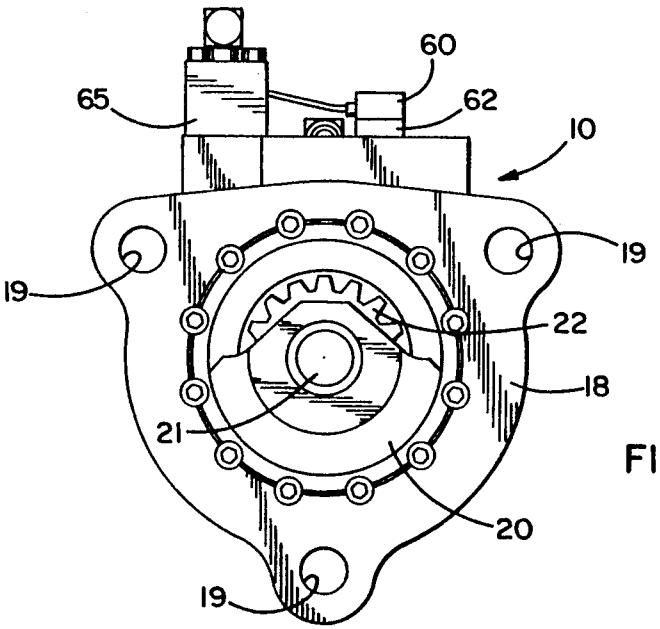
FIG. 6 is an end view of the starter as seen from the right of FIG. 5.

As shown in FIGS. 2 and 5, an air hose 69 leads from the main air chamber 58 to the inlet of the valve 65 while a passage 71 (FIGS. 2–4) leads from an outlet of the valve to the chamber 47. When the solenoid 67 is deenergized and the valve 65 is in its normal position, pressurized air is prevented from entering the valve, and air in the chamber 47 is vented to atmosphere via the passage 71 and a vent outlet of the valve. Upon energization of the solenoid and shifting of the valve, the inlet of the valve is opened, the vent outlet of the valve is closed, and pressurized air from the chamber 58 flows to the chamber 47 via the hose 69, the valve 65 and the passage 71. As an incident to pressurization of the chamber 47, the piston 49 is advanced from the position shown in FIG. 3 to the position shown in FIG. 4 in order to shift the drive gear 22 toward its active starting position.

The advancing drive gear 22 moves into meshing engagement with the bull gear and, as an incident thereto, the O-ring 50 on the piston 49 uncovers a passage 75 (FIGS. 3 and 4) in the housing 17 and establishes communication between that passage and the pressurized chamber 47. One end of an air hose 76 is connected to communicate with the passage 75 while the other end of such hose is connected to communicate with a passage 77 (FIGS. 2–4) extending radially into the nozzle unit 27. The inner end of the passage 77 communicates with a third chamber 80 (FIG. 4) in the nozzle unit. Thus, pressurized air from the chamber 47 is supplied to the chamber 80 via the passage 75, the hose 76 and the passage 77 whenever the piston 49 is shifted forwardly sufficiently far to cause the O-ring 50 to advance forwardly past the passage 75.

Pressurized air admitted into the passage 77 is utilized to shift a relay valve 81 (FIGS. 2–4) to a position permitting pressurized air in the main air chamber 58 to flow through the nozzles 26 to the turbine buckets 28. As shown most clearly in FIGS. 3 and 4, the valve 81 includes a piston 82 located within the chamber 80 and further includes a valve head 83 located in the chamber 58. A spring 84 acts against the valve head 83 and normally urges the valve 81 from left-to-right to a normal position shown in FIG. 3. When the valve 81 is in this position, the valve head 83 seals a passage 85 formed through a plate 86 located in the housing 17 between the chamber 58 and the nozzle unit 27. As a result, pressurized air supplied to the chamber 58 via the main air inlet 25 is prevented from flowing to the nozzle unit and effecting rotation of the turbine rotor 29. When the chamber 80 is pressurized, the pneumatic force acting against the piston 82 forces the valve 81 from right-to-left causing the valve head 83 to open the passage 85 and allow air in the chamber 58 to flow to the nozzle unit 27 and the turbine rotor 29.

Figure 3:
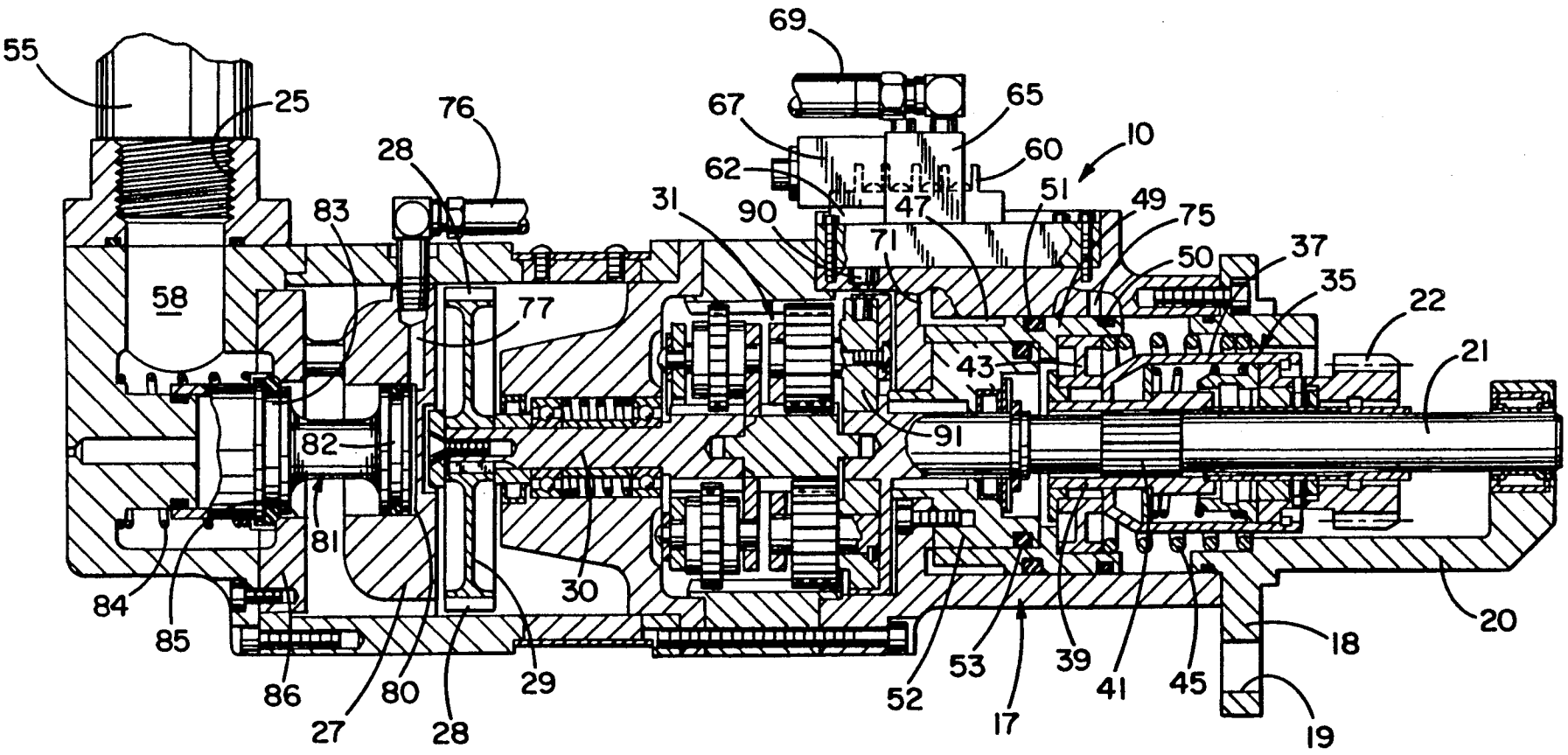
FIG. 3 is a cross-section taken longitudinally through the starter and shows the starter in its normal inactive state.

The operation of the starter 10 as described thus far now will be summarized. When the starter is inactive, its various components are positioned as shown in FIG. 3, pressurized air is present at the inlet 25 and the chamber 58, and the solenoid 67 is de-energized. The control valve 65 thus is positioned to prevent pressurization of the chamber 47 and to vent such chamber to atmosphere. As a result, the piston 49 and the drive gear 22 are retracted. In addition, the chamber 80 is de-pressurized and thus the spring 84 causes the valve head 83 of the valve 81 to close the passage 85 and prevent pressurized air in the chamber 58 from flowing to the nozzle unit 27 and the turbine rotor 28.

The starter 10 is activated by closing the key-operated switch 12 and the button-operated switch 13. This energizes the solenoid 67 via the microprocessor 62 and causes shifting of the control valve 65 to a position admitting pressurized air from the main air chamber 58 into the chamber 47 via the hose 69, the valve 65 and the passage 71. With the chamber 47 pressurized, the piston 49 and the drive gear 22 are advanced forwardly to cause the drive gear to engage the bull gear. After such engagement occurs, the O-ring 50 on the piston 49 moves forwardly past and uncovers the passage 75 to supply pressurized air from the chamber 47 to the chamber 80 by way of the passage 75, the air hose 76 and the passage 77.

When pressurized air is admitted into the chamber 80, the piston 82 is shifted to cause the valve head 83 of the valve member 81 to open the passage 85. Accordingly, pressurized air in the chamber 58 flows through the passage 85, flows through the nozzles 26 of the nozzle unit 27 and impacts against the buckets 28 of the turbine rotor 29. This effects rotation of the rotor and the shaft 30 to drive the speed reducer 31, the shaft 21 and the drive gear 22. Thus, the drive gear, after first engaging the bull gear, rotates the latter to start the engine.

Figure 7:
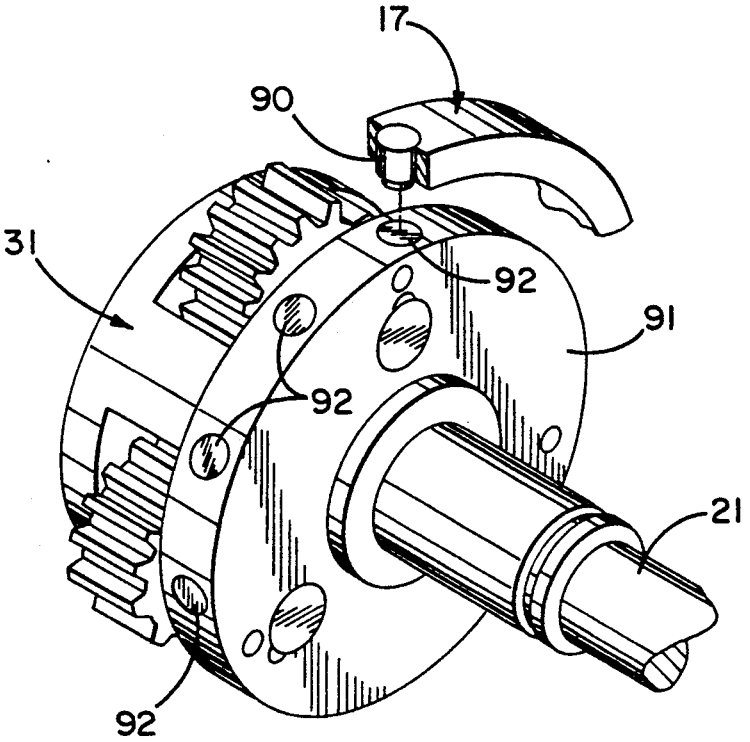
FIG. 7 is an exploded perspective view of certain components of the starter.

Means are provided for shutting down the starter 10 once the engine has started. Herein, these means comprise a Hall effect sensor 90 (FIGS. 3 and 7) supported within a component of the housing 17 and having an output connected to the microprocessor 62. The sensor 90 is disposed in opposing relation with the periphery of a disc 91 which is secured to rotate with the rear end portion of the shaft 21. Carried by the disc 91 are several (e.g., eight) angularly spaced permanent magnets 92 having poles substantially flush with the periphery of the disc. The "north" pole of every other magnet is located adjacent the periphery of the disc while the "south" poles of the intervening magnets are located adjacent the disc periphery.

As the shaft 21 rotates, the magnets 92 sweep past the sensor 90 and cause the sensor to produce alternating positive and negative output signals. The microprocessor 62 monitors the frequency with which the signals change and, when the change of frequency reaches a preset value indicating that the engine has started, the microprocessor de-energizes the solenoid 67 to cause the control valve 65 to return to its normal position. The chamber 47 thus is vented to atmosphere via the passage 71 and the valve 65 and, at the same time, the chamber 80 is vented to atmosphere via the passage 77, the hose 76, the chamber 47, the passage 71 and the valve 65. As a result of venting the chamber 80, the spring 84 returns the valve 81 to the normal position of FIG. 3 to cut off the flow of air to the nozzle unit 27 and the turbine rotor 29 and thereby terminate driving of the shaft 21 by the rotor. By virtue of venting the chamber 47, the spring 45 returns the piston 75 to its normal position of FIG. 3 so as to retract the drive gear 22 out of engagement with the bull gear.

In addition to effecting shut down of the starter 10 when the engine starts, the sensor 90 also serves as an overspeed protector. In the event that a malfunction causes the turbine rotor 29 to exceed a safe speed, the sensor effects shut down of the starter in the manner described above.

From the foregoing, it will be apparent that the present invention brings to the art a new and improved electro-pneumatic engine starter 10 in which the solenoid-operated control valve 65 and the relay valve 81 are part of the starter unit itself and are carried directly by the starter housing 17. As a result, the starter may be installed by bolting the starter to the engine and by connecting the single air line 55 and the single electrical line 56. It also will be noted that the relay valve 83 lies along the same axis as the shaft 21. This enables the starter to be constructed as a compact unit and, in addition, moisture in the housing 17 does not interfere with operation of the valve.

We claim:

1. An electro-pneumatic engine starter comprising a housing, a shaft supported by said housing to rotate about a predetermined axis, an engine drive gear supported to rotate with said shaft and supported to move along the axis of the shaft between inactive and starting positions, a turbine rotor rotatably supported within said housing and operable when rotated to rotate said shaft, first and second chambers located within said housing, means for admitting pressurized air into said first chamber, a first control valve mounted directly on and attached directly to said housing and shiftable between first and second positions, said valve being operable when in said first position to admit pressurized air from said first chamber into said second chamber and being operable when in said second position to allow pressurized air to exhaust from said second chamber to atmosphere, a selectively energizable electrically operated actuator connected to said valve and operable when energized to shift said valve from said second position to said first position, said valve being shifted from said first position to said second position when said actuator is de-energized, means in said second chamber and operable to shift said drive gear to said starting position when pressurized air is admitted into said second chamber, said drive gear shifting to said inactive position when pressurized air is exhausted to atmosphere from said second chamber, a second valve within said housing and normally isolating said turbine rotor from pressurized air in said first chamber, and means responsive to movement of said drive gear to said starting position for causing said second valve to shift to an active position enabling pressurized air from said first chamber to impact upon and rotate said turbine rotor whereby said rotor rotates said shaft and said drive gear, said second valve being supported to shift to its active position along said axis.

2. An electro-pneumatic engine starter as defined in claim 1 further including a third chamber in said housing, said second valve being shifted to its active position when said third chamber is pressurized, a passage leading from said second chamber toward said third chamber, said responsive means comprising means normally closing said passage and operable to open said passage in response to movement of said drive gear to said starting position whereby pressurized air flows from said second chamber to said third chamber to shift said second valve to its active position.

* * * * *